US006846279B2

(12) United States Patent
Stieler et al.

(10) Patent No.: US 6,846,279 B2
(45) Date of Patent: Jan. 25, 2005

(54) DRIVE FOR A CYLINDER OF A ROTARY PRINTING MACHINE

(75) Inventors: Andreas Stieler, Augsburg (DE); Nils-Hendric Schall, Augsburg (DE); Karsten Stansch, Plauen (DE); Ulrich Seyffert, Syrau (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 54 days.

(21) Appl. No.: 10/152,092

(22) Filed: May 21, 2002

(65) Prior Publication Data

US 2002/0177514 A1 Nov. 28, 2002

(30) Foreign Application Priority Data

May 21, 2001 (DE) ..... 101 24 977

(51) Int. Cl.[7] ..... B31F 1/08
(52) U.S. Cl. ..... 493/424; 493/429; 101/216
(58) Field of Search ..... 101/216; 493/424, 493/429, 476, 430, 431, 432, 433

(56) References Cited

U.S. PATENT DOCUMENTS 5,637,072 A * 6/1997 Michaelis ..... 493/476
5,676,056 A * 10/1997 Stein et al. ..... 101/226
5,676,630 A * 10/1997 Mayr ..... 493/424
5,901,647 A * 5/1999 Kohlmann ..... 101/216
5,979,317 A * 11/1999 Singler ..... 101/218
6,004,242 A * 12/1999 Kostiza ..... 475/341
6,487,965 B2 * 12/2002 Stieler et al. ..... 101/216
6,752,751 B2 6/2004 Jackson et al.

FOREIGN PATENT DOCUMENTS

| | | | |
|---|---|---|---|
| DE | 1 561 073 | 9/1971 | B41F/13/62 |
| DE | 76 06 107 | 8/1977 | B65H/45/12 |
| DE | 37 26 239 | 7/1989 | B41F/13/62 |
| DE | 43 22 744 | 1/1995 | G05D/3/12 |
| DE | 44 26 987 | 2/1996 | B41F/13/60 |
| DE | 195 25 169 | 9/1996 | B41F/13/54 |
| EP | 0 741 019 | 4/1996 | B41F/13/60 |

* cited by examiner

*Primary Examiner*—Eugene Kim
*Assistant Examiner*—Christopher Harmon
(74) *Attorney, Agent, or Firm*—Cohen, Pontani, Lieberman & Pavane

(57) ABSTRACT

A cylinder of a rotary printing machine has cylinder parts that can be driven and rotated independently of one another. The cylinder parts each have a drive connection to an electric motor and can be driven independently of one another.

14 Claims, 2 Drawing Sheets

DRIVE FOR A CYLINDER OF A ROTARY PRINTING MACHINE

BACKGROUND OF THE INVENTION

1. Field of the Invention

The invention relates to a drive for a cylinder of a rotary printing machine, which has cylinder parts that can be driven and rotated independently of one another.

2. Description of the Related Art

U.S. Pat. No. 5,676,630 discloses a drive for folding cylinders of a folder of a rotary printing machine, in detail a blade cylinder, a pin folding blade cylinder, a folding jaw cylinder and a gripper cylinder having a drive connection via spur gears and being driven mechanically in series. The pin folding blade cylinder and the folding jaw cylinder are in each case designed as two-part cylinders, as they are known, that is to say they comprise cylinder parts which are nested in each other and can be rotated with respect to each other. The cylinder parts bear systems, for example folding blades or folding jaws, which, in the event of an adjustment of the folder, can be adjusted in terms of their circumferential spacing from adjacent systems. In this way, for example, the prefold can be adjusted or a format adjustment can be carried out. The adjustment of the cylinder parts is carried out by means of planetary gear mechanisms.

In the case of this folder, the outlay on mechanisms is high. In addition, rotational flank play in the drive adds up.

SUMMARY OF THE INVENTION

It is an object of the invention to provide a mechanically simple drive for cylinders having mutually rotatable parts.

According to the invention, the cylinder parts each have a drive connection to an electric motor and can be driven independently of one another. In addition to the cylinder gears of the cylinder, the drive contains no further mechanisms, as a result of which rotational flank play is minimized. With the cylinders, operations can be carried out appropriately accurately, for example with a folding cylinder, folds can be carried out accurately, the prefold can be set and implemented accurately. Folding differences are minimized decisively as a result of the angular position of the functional groups in relation to one another, which can be maintained with high accuracy.

With the use of an electronic, virtual line shaft for the electric motors for predefining position and rotational speed, the accuracy of the synchronous running between the functional groups, and therefore the operating accuracy, is increased considerably, both in stationary and in dynamic terms. By means of an electronic predefinition of an angular offset between the functional groups, adjustments can be set flexibly, quickly and highly accurately.

The proposed drive necessitates a reduction of the masses which are connected in series and never rotate ideally, the never ideal mechanical contact points and the disturbances associated with these. Because of the reduction in the masses connected in series, the mechanical contact points and the associated compliances, an increase in the torsional stiffness in the individual functional groups is achieved. Disturbances, for example as a result of blade and folding impacts, in individual functional groups are decoupled. There is an increase in the stiffness with regard to disturbances/a reduction in the susceptibility with respect to disturbances from, for example, blade and folding impacts, because of the stiffer connection between the motor and the location of the disturbance, and therefore sharper control. The lower complexity and higher stiffness of the separated functional groups makes the use of periodic and adaptive compensation controllers possible, with which an increase in the stiffness with respect to disturbances/a reduction in the susceptibility with respect to disturbances is feasible. Overall, therefore, an increase in the accuracy of the synchronous running between the functional groups and therefore, for example, a considerable increase in the cutting and folding accuracy is possible in the case of application to folding cylinders.

The drive makes the assessment of motor/drive control variables possible, such as motor current and control differences, with which, for example, the mechanical wear of cutting and folding blades can be assessed.

By means of mechanical end stops, hardware limit switches or software limit switches, safeguarding against drive disturbances is readily possible. The drive makes use of elements of simple design and can therefore be produced cost-effectively.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 1:
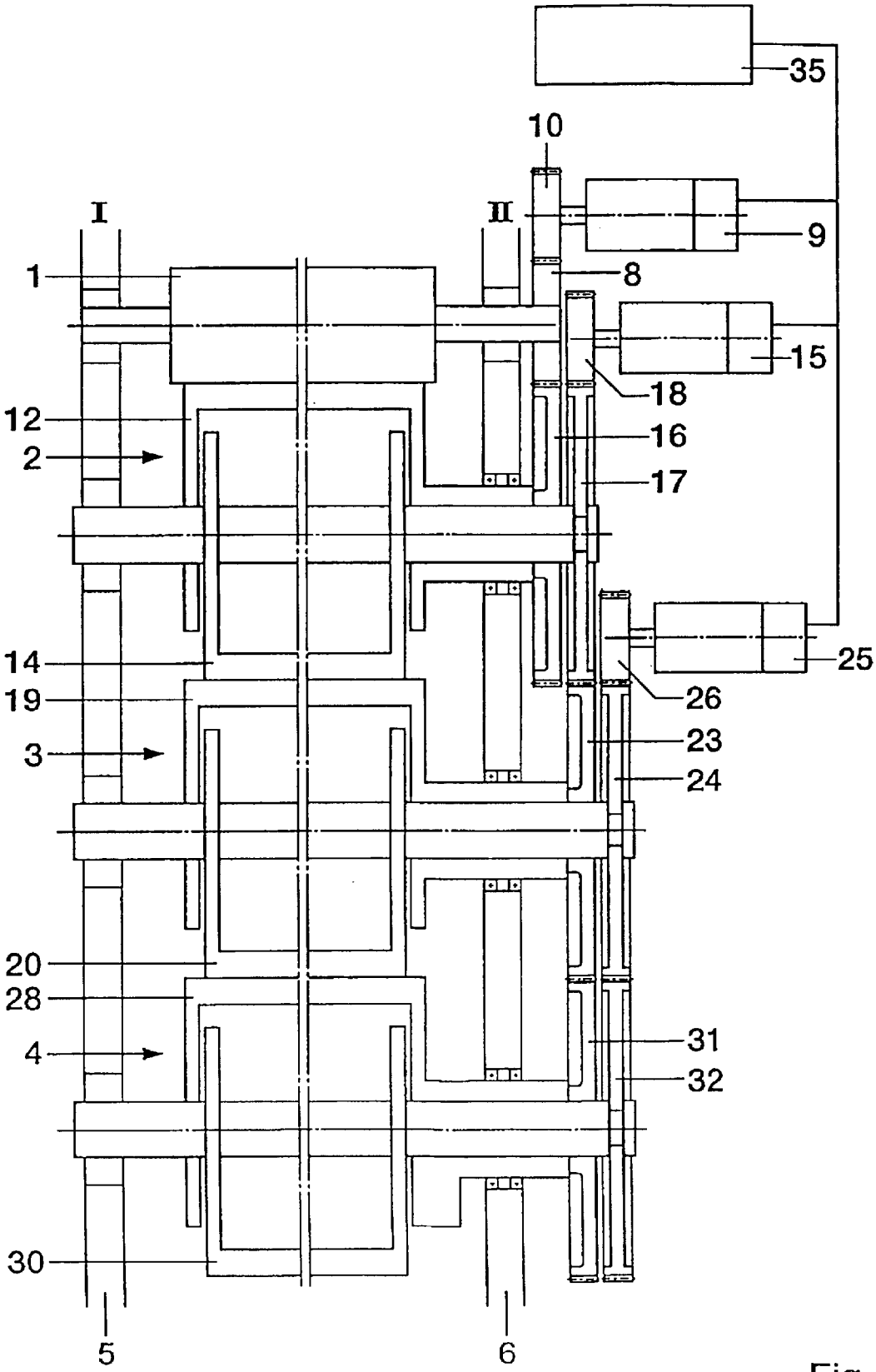
FIG. 1 is a schematic plan view showing the drive of a folder.
Figure 2:
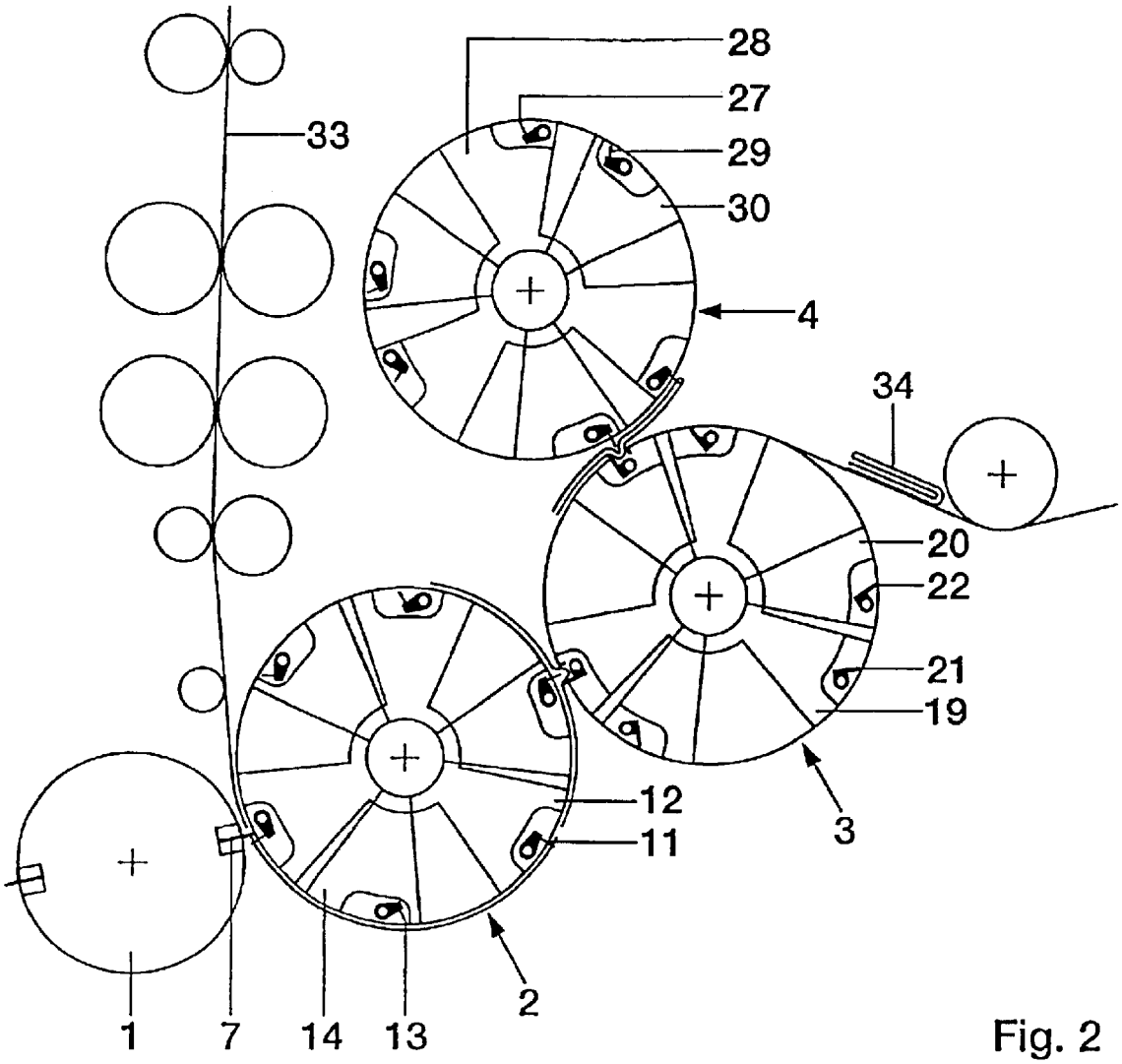
FIG. 2 is a schematic side view showing the folder according to FIG. 1.

FIG. 1 shows a folder in an extended arrangement of its cylinders and drive gears. In detail, the folder contains a knife cylinder 1, a folding cylinder 2, a folding jaw cylinder 3 and a gripper folding blade cylinder 4. The cylinders are mounted in side walls 5, 6. The knife cylinder 1 is, for example, fitted with two mutually opposite cutting knives 7 (FIG. 2). A spur gear 8, in which an electric motor 9 engages with its pinion 10, is fixed to a journal of the knife cylinder 1.

The folding cylinder 2 comprises a cylinder part 12 bearing holding elements 11 and a further cylinder part 14 bearing folding blades 13. The cylinder parts 12, 14 are, for example, designed in three segments, that is to say they bear three holding elements 11 or folding blades 13 offset through 120°. The cylinder parts 12, 14 can be rotated with respect to one another. In addition, they can be driven independently of one another and therefore each have a drive connection to a dedicated electric motor 9, 15. For this purpose, a spur gear 16, 17 is fixed to each cylinder part 12, 14. The spur gear 16 of the cylinder part 12 is directly engaged with the spur gear 8 and is therefore driven indirectly via the latter by the electric motor 9, which engages with its pinion 10 in the spur gear 8. Likewise, the electric motor 9 could engage with its pinion 10 in the spur gear 16. The electric motor 15 engages with its pinion 18 in the spur gear 17 of the further cylinder part 14.

The folding jaw cylinder 3 operates together with the folding cylinder 2. The former in turn comprises two cylinder parts 19, 20, the cylinder part 19 bearing folding jaws 21 and the further cylinder part 20 bearing folding jaws 22. The cylinder parts 19, 20 are, for example, in each case designed in three parts, so that they each bear three folding jaw systems 21, 22. The cylinder parts 19, 20 can be rotated with respect to one another and driven independently of one another. For this purpose, a spur gear 23, 24 is fixed to each cylinder part 19, 20. The spur gear 23 of the cylinder part 19 is engaged with the spur gear 17 of the further cylinder part 14, by which means the cylinder part 19 has a drive connection, indirectly via the spur gear 17, to the electric motor 15. Likewise, the pinion 18 of the electric motor 15 could engage directly in the spur gear 23. An electric motor 25 engages with its pinion 26 in the spur gear 24 of the further cylinder part 20.

The gripper folding blade cylinder 4 operates together with the folding jaw cylinder 3. The former contains a cylinder part 28 bearing grippers 27 and a further cylinder part 30 bearing folding blades 29. In each case a spur gear 31, 32 is fixed to the two cylinder parts 28, 30. The spur gear 31 of the cylinder part 28 meshes with the spur gear 23 of the further cylinder part 20 of the folding jaw cylinder 3, while the spur gear 32 of the further cylinder part 30 is engaged with the spur gear 24 of the further cylinder part 20.

A stream 33, which can already have been folded longitudinally, for example by means of a folding former, is fed to the folding cylinder 2 via pull rolls and perforating devices, not specifically described. In interplay with the folding cylinder 2, the cutting knives 7 of the knife cylinder 1 cut the stream 33 into products 34, which are picked up by the holding elements 11 of the folding cylinder, for example pins. During this interplay between the knife cylinder 1 and the folding cylinder 2, the knife cylinder 1 and the cylinder part 12 bearing the holding elements 11 have a drive connection via their spur gears 8, 16 and are driven by the electric motor 9. The cylinder part 14 is driven synchronously with the cylinder part 19 by means of the electric motor 15, which engages with its pinion 18 in the spur gear 17 of the further cylinder part 14. The electric motors 9 and 15, and also the electric motor 25, are asynchronous motors, which are driven with position control via an electronic, virtual line shaft, as it is known. Drives of this type are familiar to those skilled in the art and described, for example, in U.S. Pat. No. 5,610,491. Synchronous motors or other highly accurate motors can also be used.

During the onward rotation of the folding cylinder 2, the product 34 on the folding cylinder is transferred by the folding blade 13 into a folding jaw 21 of the folding jaw cylinder 3, a cross fold being produced. The interplay of the folding blade 13 with the folding jaw 21 is in this case divided by the drive connection between the cylinder parts 14 and 19 bearing the aforesaid elements, via their spur gears 17 and 23. From the folding jaw 21, the product is transferred to the grippers 27 of the cylinder part 28 of the gripper folding blade cylinder 4. Here, too, the interplay of the folding jaw 22 and of the gripper 27 is ensured via the spur gears 24 and 31 of the cylinder parts 19, 28 bearing the aforesaid elements 21, 27.

The product 34 on the gripper folding blade cylinder 4 is transferred from the folding blades 29 into the folding jaws 22 of the folding jaw cylinder 3, forming a second cross fold. The interplay of the aforesaid folding blades 29 and of the folding jaw 22 is ensured by the drive connection between the cylinder parts 30, 20 bearing them, via the spur gears 32, 24 connected to the latter. The drive to these cylinder parts 30, 20 is carried out in synchronism with the other cylinder parts 28, 19 of the gripper folding blade cylinder 4 and the folding jaw cylinder 3 by means of the electric motor 25. The product 34, now cross-folded twice, is finally led away by the folding jaw cylinder 3. The production of a product 34 with the present cylinders 1 to 4, apart from their drive, is per se familiar to those skilled in the art and therefore does not need to be described in detail. More detailed explanations are provided, for example, in U.S. Pat. No. 5,676,630, already mentioned at the beginning.

For adjustments of the folder, for example for a pre-fold adjustment, the folding blade 13 has to be rotated with respect to the holding elements 11. This is carried out by means of a temporary leading or lagging operation of the electric motor 15 with respect to the electric motor 9, as a result of which the angular position of the electric motor 15 in relation to the electric motor 9 is changed. In a corresponding way, the cylinder part 14 with its folding blades 13 is rotated with respect to the cylinder part 12 with the holding elements 11.

On the same principle, the position of the second cross fold produced by the folding blade 29 can also be changed with respect to the first cross fold. The electric motor 25 is temporarily operated so as to lead or lag, depending on whether the second cross fold is to be produced closer to the first cross fold or further away from the latter. In this way, the angular position of the cylinder part 30 bearing the folding blade 29 is changed with respect to the cylinder parts 19 driven by the electric motor 15 and bearing the folding jaw 21.

The angular positions to be set on the electric motors 15 and 25 for the desired positioning of the cylinder part 14 with the folding blade 3 and, respectively, the cylinder part 30 with the folding blade 29, and also positions of the electric motor 9, are stored in a computing and storage unit 35. This is connected to the input of the motor control system of the electric motors 9, 15, 25. For an adjustment of the aforesaid elements, the desired angular positions are called up by the computing and memory unit 35 and predefined to the motor control system of the electric motors 9, 15, 25. Instead of this, it is also possible to enter the desired adjustments manually at the control desk of the printing machine.

Figure 3:
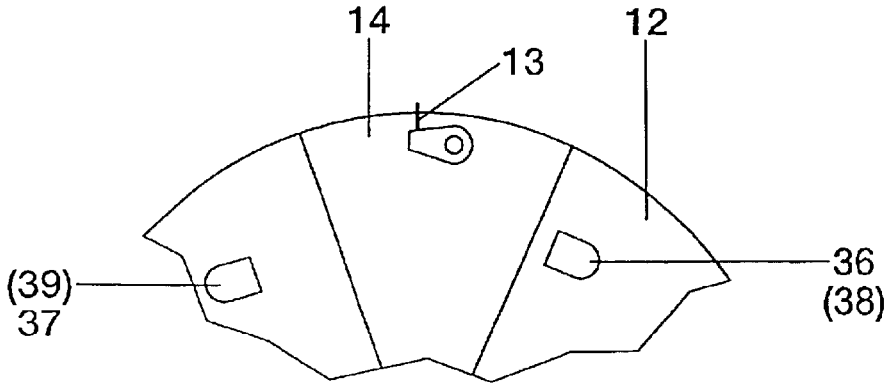
FIG. 3 shows the view III from FIG. 1.

Fitted to the cylinder part 12 are two stops 36, 37, which limit the mutual rotatability of the cylinder parts 12 and 14. Stops of this type are also present on the folding jaw cylinder 3 and the gripper folding blade cylinder 4, in order to limit the mutual rotatability of the cylinder parts 19, 20 and 28, 30. Instead of or in conjunction with the mechanical stops 36, 37, hardware limit switches, for example limit switches 38, 39, can also be used. Limit switches 38, 39 of this type are also specified in FIG. 3, placed in brackets. As a further possible safeguard, the position control system of the electric motors 9, 15, 25 also contains desired limiting values for their mutual angular offset, which provides a limitation on the mutual rotatability of the cylinder parts 12, 14, 19, 20, 28, 30.

In the exemplary embodiment, the folding jaw cylinder 3 comprises two cylinder parts 19, 20. In the case of folders, the gripper folding blade cylinder 4 can also be dispensed with, if only one cross fold is to be produced. In this case, the subdivision of the folding jaw cylinder 3 into cylinder parts can be dispensed with and this cylinder can comprise only one body, the electric motor 25 then also being superfluous.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

We claim:

1. A drive system for a folder of a rotary printing machine, said folder comprising a folding cylinder and a folding jaw cylinder, said folding cylinder comprising a first cylinder part bearing a holding element and a second cylinder part bearing folding blades, said folding jaw cylinder comprising a first cylinder part, said first and second cylinder parts of said folding cylinder being rotated independently of one another about a common axis, said drive system comprising a spur gear fixed to said second cylinder part of said folding cylinder and a spur gear fixed to said first cylinder part of said folding jaw cylinder, said spur gears being directly engaged, and first and second electric motors for driving respective said first and second cylinder parts of said folding cylinder independently of one another.

2. A drive system as in claim 1 wherein said folding jaw cylinder comprises first and second cylinder parts which each bear folding jaws, said folder further comprising a gripper folding blade cylinder comprising a first cylinder part bearing grippers and a second cylinder part bearing folding blades, said drive system further comprising a spur gear fixed to said second cylinder part of said folding jaw cylinder and a spur gear fixed to each of said first and second cylinder parts of said gripper folding blade cylinder, said spur gear of said first cylinder part of said folding jaw cylinder directly engaging said spur gear of said first cylinder part of said gripper folding blade cylinder, said spur gear of said second cylinder part of said folding jaw cylinder directly engaging said spur gear of said second cylinder part of said gripper folding blade cylinder, and a third electric drive motor for driving said second cylinder parts of said folding jaw cylinder and said gripper folding blade cylinder.

3. A drive system as in claim 1 wherein said folder further comprises a knife cylinder, said drive system further comprising a spur gear fixed to said first cylinder part of said folding cylinder and a spur gear fixed to said knife cylinder, said spur gear fixed to said first cylinder part of said folding cylinder and said spur gear fixed to said knife cylinder being directly engaged, and a pinion belonging to said first electric motor, said pinion engaging in one of said spur gear fixed to said first cylinder part of said folding cylinder and said spur gear fixed to said knife cylinder.

4. A drive system as in claim 1 further comprising a position control system comprising a computing and memory unit in which preset angular positions of said cylinders are stored, said computing and memory unit being connected to said electric motors.

5. A drive system as in claim 1 further comprising stops arranged on each of said first and second cylinder parts, said stops limiting relative rotatability of said cylinder parts.

6. A drive system as in claim 1 further comprising hardware limit switches arranged on each of said first and second cylinder parts, said hardware limit switches limiting relative rotatability of said cylinder parts.

7. A drive system as in claim 4 wherein said computing and memory unit stores limiting values for the relative angular offset of the cylinder parts of each said cylinder in order to limit the relative rotatability of the cylinder parts of the cylinder parts of each said cylinder.

8. A rotary printing machine comprising a folder comprising a folding cylinder and a folding jaw cylinder, said folding cylinder comprising a first cylinder part bearing a holding element and a second cylinder part bearing folding blades, said folding jaw cylinder comprising a first cylinder part, said first and second cylinder parts of said folding cylinder being rotated independently of one another about a common axis, said drive system comprising:

a spur gear fixed to said second cylinder part of said folding cylinder and a spur gear fixed to said first cylinder part of said folding jaw cylinder, said spur gears being directly engaged; and first and second electric motors for driving respective said first and second cylinder parts of said folding cylinder independently of one another.

9. A rotary printing machine as in claim 8 wherein said folding jaw cylinder comprises first and second cylinder parts which each bear folding jaws, said folder further comprising a gripper folding blade cylinder comprising a first cylinder part bearing grippers and a second cylinder part bearing folding blades, said machine further comprising:

a spur gear fixed to said second cylinder part of said folding jaw cylinder and a spur gear fixed to each of said first and second cylinder parts of said gripper folding blade cylinder, said spur gear of said first cylinder part of said folding jaw cylinder directly engaging said spur gear of said first cylinder part of said gripper folding blade cylinder, said spur gear of said second cylinder part of said folding jaw cylinder directly engaging said spur gear of said second cylinder part of said gripper folding blade cylinder; and a third electric drive motor for driving said second cylinder parts of said folding jaw cylinder and said gripper folding blade cylinder.

10. A rotary printing machine as in claim 8 wherein said folder further comprises a knife cylinder, said drive system further comprising:

a spur gear fixed to said first cylinder part of said folding cylinder and a spur gear fixed to said knife cylinder, said spur gear fixed to said first cylinder part of said folding cylinder and said spur gear fixed to said knife cylinder being directly engaged; and a pinion belonging to said first electric motor, said pinion engaging in one of said spur gear fixed to said first cylinder part of said folding cylinder and said spur gear fixed to said knife cylinder.

11. A rotary printing machine as in claim 8 further comprising a position control system comprising a computing and memory unit in which preset angular positions of said cylinders are stored, said computing and memory unit being connected to said electric motors.

12. A rotary printing machine as in claim 8 further comprising stops arranged on each of said first and second cylinder parts, said stops limiting relative rotatability of said cylinder parts.

13. A rotary printing machine as in claim 8 further comprising hardware limit switches arranged on each of said first and second cylinder parts, said hardware limit switches limiting relative rotatability of said cylinder parts.

14. A drive system as in claim 11 wherein said computing and memory unit stores limiting values for the relative angular offset of the cylinder parts of each said cylinder in order to limit the relative rotatability of the cylinder parts of the cylinder parts of each said cylinder.

* * * * *